US011767663B2

(12) United States Patent
Benzing

(10) Patent No.: US 11,767,663 B2
(45) Date of Patent: Sep. 26, 2023

(54) SINK INSERT

(71) Applicant: Christian P. Benzing, Stuttgart (DE)

(72) Inventor: Christian P. Benzing, Stuttgart (DE)

(73) Assignee: Christian P. Benzing, Stuttgart (DE)

( * ) Notice: Subject to any disclaimer, the term of this patent is extended or adjusted under 35 U.S.C. 154(b) by 0 days.

(21) Appl. No.: 16/978,020

(22) PCT Filed: Mar. 5, 2019

(86) PCT No.: PCT/EP2019/055399
§ 371 (c)(1),
(2) Date: Sep. 3, 2020

(87) PCT Pub. No.: WO2019/170644
PCT Pub. Date: Sep. 12, 2019

(65) Prior Publication Data

US 2020/0407958 A1 Dec. 31, 2020

(30) Foreign Application Priority Data

Mar. 8, 2018 (DE) ..... 202018101310.6
Aug. 27, 2018 (DE) ..... 202018104910.0

(51) Int. Cl.
*E03C 1/186* (2019.01)
*A47L 19/00* (2006.01)
*A47L 17/00* (2006.01)

(52) U.S. Cl.
CPC ..... *E03C 1/186* (2013.01); *A47L 19/00* (2013.01); *A47L 17/00* (2013.01)

(58) Field of Classification Search
CPC ..... E03C 1/186; A47L 19/00; A47L 19/02; A47L 19/04; A47J 47/20; A47J 43/24
USPC ..... 211/85.3, 88.01, 90.01, 41.3, 41.4; 248/200.1
See application file for complete search history.

(56) References Cited

U.S. PATENT DOCUMENTS 623,366 A * 4/1899 Halvorsen ..... A47L 19/04 220/572
670,585 A * 3/1901 Fowler ..... A47H 1/022 248/200.1
1,550,383 A * 8/1925 Morthland ..... A47J 47/20 248/212

(Continued)

FOREIGN PATENT DOCUMENTS

CH 699129 B1 * 10/2011 ..... A47J 47/20
CN 202044139 U * 11/2011

(Continued)

OTHER PUBLICATIONS

Machine Translation of CN202044139U. Google Patents. (Year: 2021).*

*Primary Examiner* — Erin Deery
(74) *Attorney, Agent, or Firm* — McNees Wallace & Nurick LLC

(57) ABSTRACT

The invention relates to a sink insert (1) with at least one holding rod (2) for cleaning rags and the like. The at least one holding rod (2) is designed to be flat at both end sections of the rod. Alternatively or in addition thereto, the sink insert (1) has bearing pieces (3) which are insertable so as to cover the edges of opposing sink edges and on which the end sections of the at least one holding rod (2) are held.

15 Claims, 2 Drawing Sheets

(56) References Cited

U.S. PATENT DOCUMENTS

| | | | | | |
|---|---|---|---|---|---|
| 3,324,613 | A * | 6/1967 | Duboff | A47B 96/1425 | 285/298 |
| 3,425,065 | A * | 2/1969 | Strong | E03C 1/186 | 15/268 |
| 4,765,603 | A * | 8/1988 | Huppert | A47J 47/005 | 269/289 R |
| 6,341,704 | B1 * | 1/2002 | Michel, Jr. | A47J 47/20 | 211/119 |
| 8,070,148 | B2 * | 12/2011 | Nishida | A47J 47/005 | 269/302.1 |
| 2011/0303626 | A1 * | 12/2011 | Roenne | A47J 47/20 | 211/71.01 |
| 2014/0259377 | A1 * | 9/2014 | Eilmus | A47J 47/20 | 4/639 |
| 2016/0143439 | A1 * | 5/2016 | Jablow | A47B 96/061 | 211/90.01 |

FOREIGN PATENT DOCUMENTS

| | | | | | |
|---|---|---|---|---|---|
| DE | 202017103679 | U1 * | 1/2018 | | |
| KR | 20140004832 | U * | 8/2014 | A47L 19/04 | |
| KR | 200475324 | Y1 * | 11/2014 | | |
| KR | 20170003004 | U * | 8/2017 | A47L 47/20 | |

* cited by examiner

SINK INSERT

FIELD OF THE INVENTION

The invention relates to a sink insert with at least one holding rod for cleaning rags and the like.

BACKGROUND OF THE INVENTION

After rinsing and cleaning support areas, cleaning rags and the like are usually placed on support surfaces next to the sink or hung in the region of the sink or at a distance from it. It is also conceivable to hang a cleaning rag, for example on a container placed in the sink for draining. Such devices are sometimes cumbersome in construction, sometimes cumbersome to use.

SUMMARY OF THE INVENTION

The present invention has for its object to provide a sink insert that allows storing cleaning rags after use in a space-saving manner and in a few simple steps.

This object is achieved by a sink insert with the features of claim 1. Here, the sink insert is provided with at least one holding rod for cleaning rags and the like, wherein the at least one holding rod is designed to be flat at both end sections of the rod, and/or the sink insert has mutually insertable bearing pieces on opposite sink edges, on which the at least one holding rod is held with the two end sections thereof.

This provides a sink insert with a simple construction and which is simple to use, which makes possible easy hanging, in particular of wet cleaning rags.

Different arrangement options and adaptation options according to different sink shapes are provided due to the fact that the at least one holding rod has a length adjustment mechanism.

An advantageous embodiment, which provides good adaptation options and also accommodation options for the sink insert, consists in that the at least one holding rod is composed of at least two partial rods which are provided with complementary interlocking sections. For example, the holding rod or, if appropriate, a plurality of holding rods can be designed to be telescopically adjustable.

Different embodiment variants consist in that the complementary interlocking sections are designed as matched plug-in sections or as matched threaded sections with an internal thread on the one hand and an external thread on the other hand.

An embodiment that is advantageous for use consists in that the length adjustment mechanism is designed to be latchable, in particular lockable.

For simple construction and use, the measures are also advantageous in that the bearing pieces are integrally designed and each have a support section which can be placed on the top of a sink edge and a support section which engages in the sink and bears against the sink wall at the associated upper region thereof, and are each provided with at least one recess on the sides thereof for receiving the facing end sections of the at least one holding rod, wherein said sides are facing each other during use. The recesses can be designed to be slightly clamping, but still ensure good detachability.

It is favorable for handling that the recesses are open at the top with respect to the position of use.

Different embodiment variants result from the fact that the at least one holding rod and/or the bearing pieces are made of plastics material, rubber, corrosion-free metal, wood, or ceramic, or have a combination of these materials. Here, for example, only the end sections of the holding rod(s) can be designed in a non-slip manner or provided with a rubber coating.

If it is provided that the at least one holding rod and/or the bearing pieces is/are provided with a non-slip structure made of rubber-elastic material at least on their side facing the sink surface during use, this results in a good holding function with good non-slip properties and gentle attachment to the sink edge.

It is also advantageous for use that the at least one holding rod and the bearing pieces are designed dishwasher-safe.

Extended possibilities of use are obtained by the fact that additional holding elements such as hooks are available for holding further cleaning utensils, which are attachable to the at least one holding rod.

DETAILED DESCRIPTION OF THE INVENTION

Figure 1:
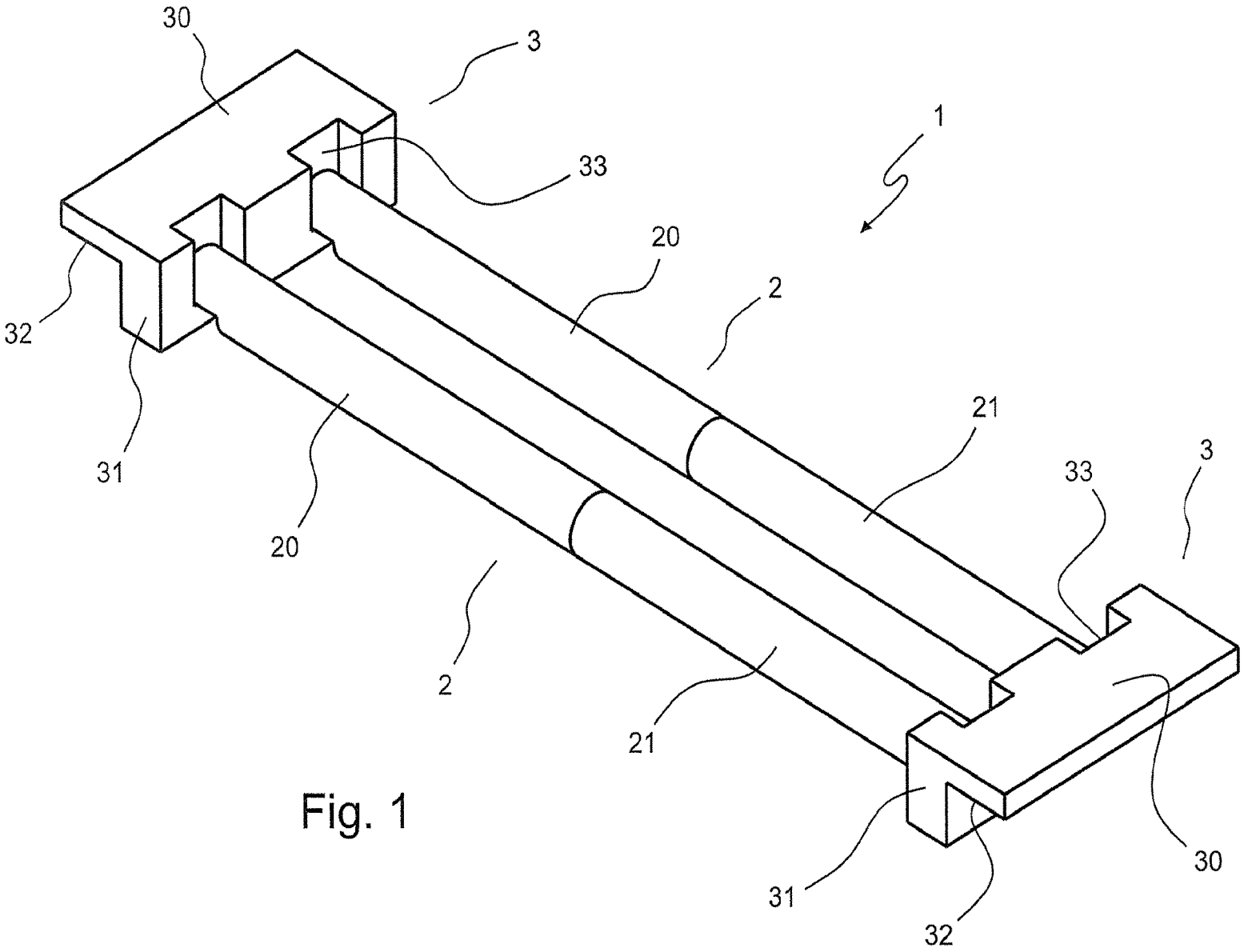
FIG. 1 is a sink insert with two holding rods and bearing pieces at the end in perspective view.

FIG. 1 shows a sink insert 1 with two holding rods 2, each of which is made up of a first partial rod 20 and a second partial rod 21 and is coaxially attached to one another in a connection region. Optionally, as previously discussed above, sink insert 1 may include one holding rod 2. At the end sections 200, 210 (FIG. 2A) thereof, the rigid or deflection-resistant holding rods 2 are inserted into recesses 33, which are arranged in bearing pieces 3. The holding rods 2 can be designed to be flat at least at their two end sections. In particular with a flat design, at least the end sections can also be used directly for support on sections of the sink edge.

During use, the bearing pieces 3 are inserted on opposite upper edge sections of a sink, for which purpose the bearing pieces 3 are provided with a support section 30, which is placed on a top of the sink surrounding the sink edge, and a support section 31, which is supported on the inside of the upper sink edge, wherein the transition region between the inside and the top of the sink engages in a recess 32 designed between the support section 30 and the support section 31. In contrast to the schematic illustration shown in FIG. 1, the transition regions and outer contours of the bearing pieces 3 can have rounded shapes.

The recesses 32 are matched to the diameter of the end sections of the holding rods 2, so that they allow the holding rods 2 to be inserted easily, wherein a slight clamping effect can also be achieved, but which makes possible an easy detachability. When using the bearing pieces 3, the end sections can have the same cross section as the adjoining part of the holding rod 2, i.e. a flat section is then not necessary. The recesses 32 are advantageously open at the top, so that the holding rods 2 can be easily inserted from above or removed from the top. In one embodiment variant, the recesses 32 are designed as plug-in openings or threaded bores into which the end sections of the holding rods 2 can be inserted or screwed.

The bearing pieces 3 can be provided, in particular on the surface regions thereof facing the sink surface, such as the recess 32, with a non-slip, e.g. rubber-elastic layer, so that they result in a simple, non-slip, and gentle mounting on the sink edge.

Figure 2A:
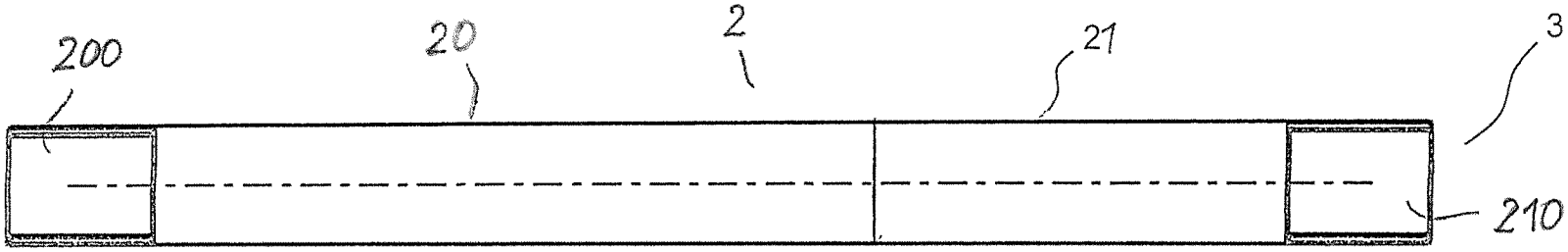
FIG. 2A is an integral holding rod.
Figure 2B:
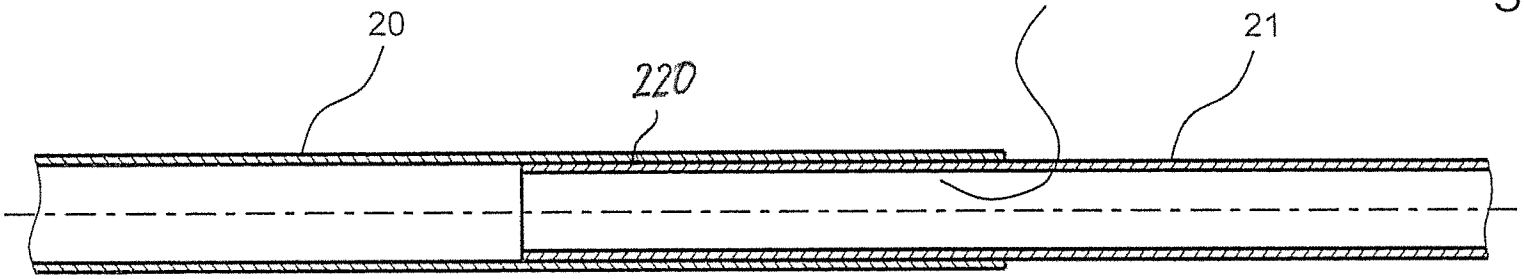
FIG. 2B is a holding rod composed of two partial rods with plug-in sections in longitudinal section.
Figure 2C:
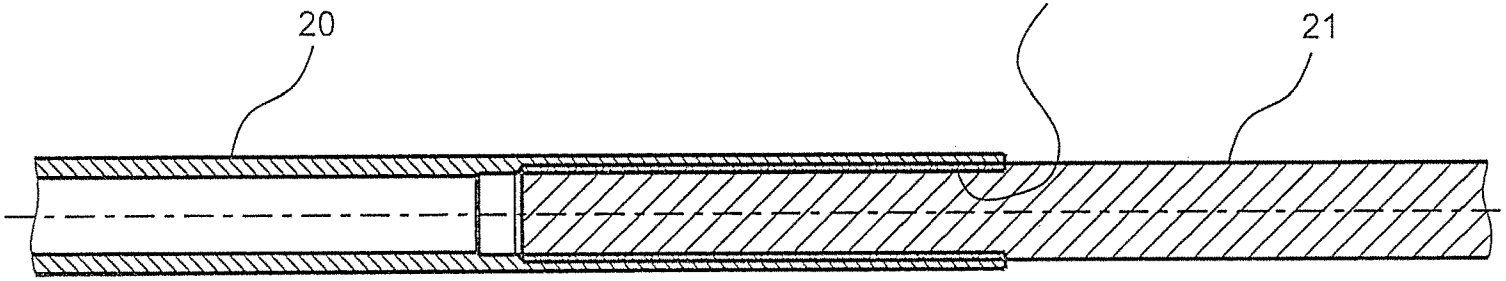
FIG. 2C is a holding rod composed of two partial rods with threaded sections in a longitudinal section.

FIG. 2A, 2B and 2C show different embodiment variants of the holding rod 2. While the holding rod in FIG. 2A is integrally designed, the embodiments according to FIG. 2B and 2C are in multiple pieces, in particular formed from a first and a second partial rod 20, 21 and composed in a connection region with complementary sections which are matched to one another. In the embodiment according to FIG. 2B, a plug-in connection 22 is provided, defining latchability 220 (FIG. 2B) in the assembled interlocking sections which allows the interlocking sections to be plugged into one another in a manner that is as free of play as possible and simple to take apart. The interlocking sections are long enough to offer a large adjustment range and thus adapt to different sink dimensions, while maintaining the deflection-resistant and somewhat elastic or rigid design in the transverse direction. This also allows the sink insert 1 to be inserted in a different orientation in a sink if its width and length differ. In the embodiment according to FIG. 2C, the connection region is provided with a threaded connection 23, which on the one hand has an internal thread and on the other hand a complementary external thread. A length adjustment mechanism of the holding rod 2 is advantageously designed latchable, i.e. lockable, formed in different adjustable lengths. The holding rod 2 or the first and second partial rods 20, 21 preferably have a round cross section, but other cross-sectional shapes are also conceivable. In particular, the end sections of the holding rod(s) 2 are designed to be flat for a good support. The holding rod(s) has/have a smooth or e.g. a surface provided with a groove structure in the longitudinal direction and can be designed from a solid or a hollow profile. When manufactured from a hollow profile, they can be open or closed at their free ends.

The individual parts of the sink insert, holding rod(s) 2, and bearing pieces 3 can be designed of different materials that meet high requirements in terms of hygiene, cleanability, and durability, for example can be made of plastics material, hard rubber, corrosion-free metal, wood, or ceramic, or combinations of these materials.

What is claimed is:

1. A sink insert comprising:

at least one holding rod for cleaning rags, wherein:

the at least one holding rod has a round-hollow cross section and is straight over a complete length of an upper portion of the at least one holding rod and includes a flat portion at opposed end sections of a lower portion of the at least holding one rod, wherein the flat portion is a flat plane in a length direction of the at least one holding rod and in a cross direction perpendicular to the length direction and transitions into the lower portion of the round-hollow cross section of the at least one holding rod, the at least one holding rod is composed of at least two partial rods which have the round-hollow cross section and are provided with complementary interlocking sections, allowing separation, the complementary interlocking sections are designed as matched plug-in sections, and the at least two partial rods are configured to be latchable, lockable, and length-adjustable.

2. The sink insert according to claim 1, wherein additional holding elements are adapted for holding further cleaning utensils, and are attachable to the at least one holding rod.

3. The sink insert according to claim 1, wherein the at least one holding rod is made of at least one of plastics, corrosion-free metal, wood, ceramic, or a combination thereof.

4. The sink insert according to claim 1, wherein each flat portion of the at least one holding rod is inserted into a recess of a bearing piece.

5. The sink insert according to claim 4, wherein each recess includes a shoulder to place the respective flat portion thereon.

6. The sink insert according to claim 4, wherein each recess is configured to receive the respective flat portion of the at least one holding rod in a vertical direction for engagement.

7. A sink insert comprising:

at least one holding rod for cleaning rags, wherein the at least one holding rod has a round-hollow cross section and is straight over a complete length and includes a flat portion at opposed end sections thereof, wherein the flat portion is a flat plane in a length direction of the at least one holding rod and in a cross direction perpendicular to the length direction and transitions into the round-hollow cross section of the at least one holding rod, the at least one holding rod is composed of at least two partial rods which have the round-hollow cross section and are provided with complementary interlocking sections, allowing separation, the complementary interlocking sections are designed as matched plug-in sections, and the at least two partial rods are configured to be latchable, lockable, and length-adjustable, further comprising a pair of bearing pieces, each bearing piece being integrally designed and having a first support section configured to be placed on a top of a sink edge and a second support section configured to engage the sink and bear against a sink wall at an associated upper region thereof, each bearing piece is provided with one recess having a shoulder therein for receiving a corresponding flat portion of the at least one holding rod, wherein the shoulder and the flat portion of the at least one holding rod face each other during use.

8. The sink insert according to claim 7, wherein the recess of each bearing piece are is open at a top with respect to a position of use.

9. The sink insert according to claim 7, wherein the at least one holding rod is made of at least one of plastics, rubber, corrosion-free metal, wood, ceramic, or combination thereof.

10. The sink insert according to claim 7, wherein the bearing pieces are provided with a non-slip structure made of rubber-elastic material at least on a side facing the sink surface during use.

11. The sink insert according to claim 7, wherein the at least one holding rod and the bearing pieces are dishwasher-safe.

12. The sink insert according to claim 7, wherein each opposed end section achieves a clamping effect when received by a corresponding bearing piece recess.

13. The sink insert according to claim 12, wherein the clamping effect is achieved between a diameter of each opposed end section and the corresponding bearing piece recess.

14. The sink insert according to claim 7, wherein the bearing pieces are made of at least one of plastics, rubber, corrosion-free metal, wood, ceramic, or combination thereof.

15. A sink insert comprising:

at least one holding rod for cleaning rags, wherein:

the at least one holding rod has a round-hollow cross section and is straight over a complete length of an upper portion of the at least one holding rod and includes a flat portion at opposed end sections of a lower portion of the at least holding one rod, wherein the flat portion is a flat plane in a length direction of the at least one holding rod and in a cross direction perpendicular to the length direction and transitions into the lower portion of the round-hollow cross section of the at least one holding rod, the at least one holding rod is composed of at least two partial rods which have the round-hollow cross section and are provided with complementary interlocking sections, allowing separation, the complementary interlocking sections are designed as matched threaded sections with an internal thread on one of the at least two partial rods and an external thread on a corresponding other of the at least two partial rods, and the at least two partial rods are configured to be latchable, lockable, and length-adjustable.

* * * * *